United States Patent [19]

Mezger et al.

[11] Patent Number: 4,523,555

[45] Date of Patent: Jun. 18, 1985

[54] RECIPROCATING INTERNAL COMBUSTION ENGINE WITH A WET CYLINDER SLEEVE INSERTED INTO A CYLINDER CRANK HOUSING

[75] Inventors: Hans Mezger, Freiberg; Reinhard Konneker, Monsheim, both of Fed. Rep. of Germany

[73] Assignee: Harley-Davidson Motor Co., Inc., Milwaukee, Wis.

[21] Appl. No.: 630,515

[22] Filed: Jul. 13, 1984

[30] Foreign Application Priority Data

Jul. 21, 1983 [DE] Fed. Rep. of Germany ..... 3326320

[51] Int. Cl.[3] ..... F01P 9/04

[52] U.S. Cl. ..... 123/193 C

[58] Field of Search ..... 123/193 C, 193 CP, 41.57, 123/41.84, 41.83

[56] References Cited

U.S. PATENT DOCUMENTS 1,516,058 11/1924 Porter ..... 123/41.57
1,647,554 11/1927 Trapnell ..... 123/41.57
2,464,652 3/1949 Petersen ..... 123/41.83
3,643,637 2/1972 Strossner et al. ..... 123/193 C
4,340,018 7/1982 Kirk ..... 123/193 C

FOREIGN PATENT DOCUMENTS 2839622 3/1979 Fed. Rep. of Germany ... 123/41.57

*Primary Examiner*—E. Rollins Cross

[57] ABSTRACT

A reciprocating internal combustion engine includes at least one wet cylinder sleeve which is inserted into a cylinder crank housing. The upper portin of the sleeve is clamped between a cylinder head and a cylindrical receptacle disposed inside the cylinder crank housing. Coolant flows through a space adjacent said upper portion. A lower portion of the cylinder sleeve is separated from the coolant and extends inside the receptacle. To achieve a favorable temperature pattern over the entire height of the cylinder sleeve, the coolant containing space has a broad cross-section in the upper portion of the cylinder sleeve formed by a constricted wall on the outer periphery of the cylinder sleeve. Furthermore, a closed annular air space is provided between the cylindrical receptacle and the lower portion of the cylinder sleeve.

9 Claims, 1 Drawing Figure

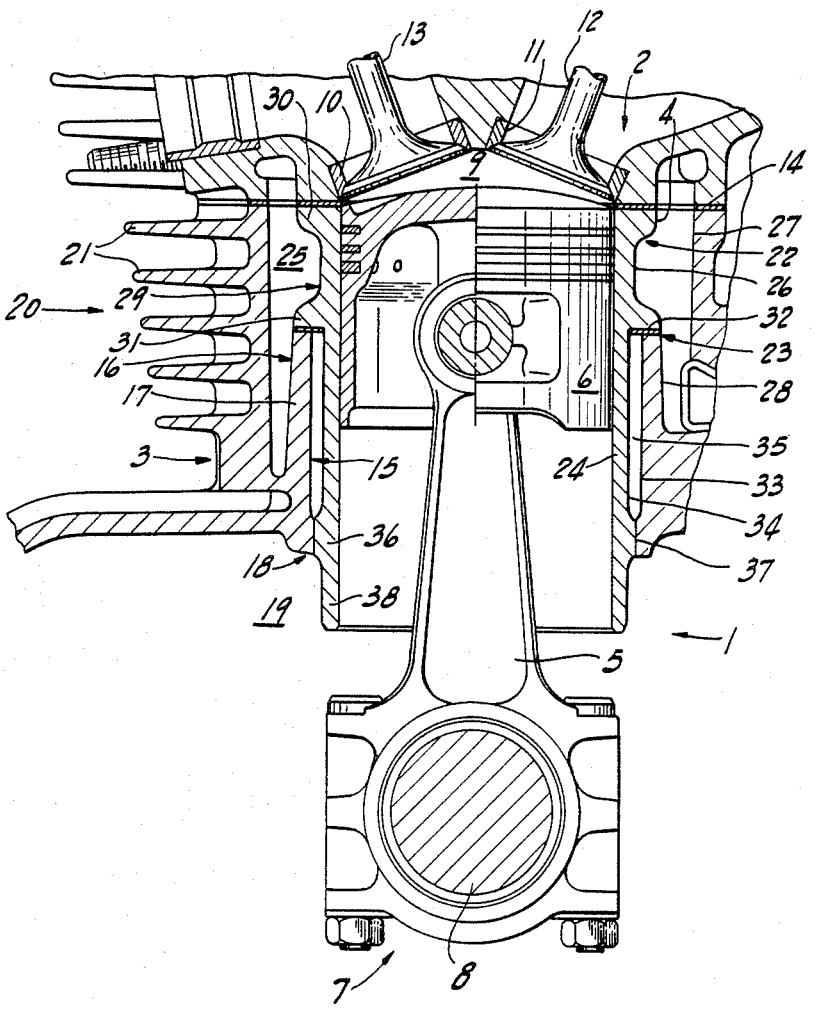
13
12
11
2
30
10
4
9
14
27
21
25
22
26
20
29
32
31
23
16
6
28
17
35
3
15
24
33
36
34
18
37
19
38
1
5
7
8

RECIPROCATING INTERNAL COMBUSTION ENGINE WITH A WET CYLINDER SLEEVE INSERTED INTO A CYLINDER CRANK HOUSING

BACKGROUND OF THE INVENTION

1. Field of the Invention

The present invention relates to a reciprocating internal combustion engine with a wet cylinder sleeve.

2. Description of the Prior Art

A cylinder sleeve, around which the coolant flows only in the upper portion, is disclosed in German Offenlegungsschrift No. 20 30 983. In this device, the lower portion of the cylinder sleeve is inserted into a cylindrical receptacle, the cylinder sleeve and the receptacle being adjacent each other over the entire length of the receptacle. No space is formed therebetween. This arrangement has the disadvantage that the cylinder sleeve has an unfavorable temperature pattern over its length. The upper portion of the cylinder sleeve which is subjected to particularly high heat stress (near the combustion chamber) is cooled too slowly, since at that point the cylinder sleeve has a large wall thickness. The device also has the disadvantage of unnecessary weight. Furthermore, the space towards the cylinder head, which extends between the cylinder crank housing and the cylinder sleeve, and which contains the coolant, is very small so that the volume of coolant present in this region does not give a satisfactory cooling effect. Furthermore, owing to the contact between the receptacle and the cylinder sleeve, the lower portion of the cylinder sleeve, which is typically colder, cools quickly when the reciprocating internal combustion engine is operating. During cold starts, it warms too slowly. On account of this slow heating of the lower portion of the cylinder sleeve, the ignition flame is extinguished (flame blow-out effect). This is particularly the case in the lower load range of operation of the internal combustion engine and results in an increased hydrocarbon emission.

OBJECTS AND SUMMARY OF THE INVENTION

The primary object of the present invention is to provide a cylinder sleeve which provides a favorable temperature pattern over its entire length during both partial and full operating loads of the reciprocating internal combustion engine.

How this object is accomplished will be described in the following specification, taken in conjunction with the drawing. Generally, however, this object is achieved by providing a cross-sectional broadening of a coolant flow space in the upper portion of a wet cylinder sleeve. A closed air space is also provided between a sleeve receptacle and the lower region of the cylinder sleeve. The cross-sectional broadening is accomplished by a constricted wall disposed on the outer periphery of the cylinder sleeve and provides good cooling. The weight of the cylinder sleeve is also kept to a minimum. The closed annular air space, disposed between the receptacle and the lower portion of the cylinder sleeve, acts as an insulator. This portion of the cylinder sleeve heats more quickly during cold starts because of the reduced heat transfer from the cylinder sleeve via the air space to the receptacle. This counteracts the tendency to extinguish the flame in the low load range of the internal combustion engine and, therefore, insures decreased hydrocarbon emissions. Owing to the quicker heating of the lower portion of the cylinder sleeve during the cold start phase, thermal and mechanical efficiency of the internal combustion engine is also improved. Furthermore, because the cylinder sleeve is supported at its upper end, low-vibration of the latter is guaranteed.

DESCRIPTION OF THE DRAWING

The FIGURE is a cross-section of a portion of an internal combustion engine, illustrating the wet cylinder sleeve according to the preferred embodiment of the present invention.

DESCRIPTION OF THE PREFERRED EMBODIMENT

A water-cooled reciprocating internal combustion engine 1 of the Otto type, includes a cylinder head 2, a cylinder crank housing 3, a wet cylinder sleeve 4 and a piston 6 cooperating with a connecting rod 5. The connecting rod 5 is connected to a crankshaft 8 by connection elements 7. A combustion chamber 9, valve seats 10, 11 for an inlet valve 12 and an outlet valve 13 are also illustrated.

The cylinder head 2, made preferably of aluminum die cast metal, is inserted along with a gasket 14, onto the cylinder crank housing 3 and is connected thereto by means of bolts which are not shown in the drawings.

The cylinder crank housing 3 is preferably made of an aluminum alloy and produced in chill casting and has a cylindrical receptacle 16 in its interior 15. The receptacle 16 is formed by a tubular connection piece 17, whose lower end 18 is connected in one piece to the outer cylinder crank housing 3. The lower end is above the crank space 19. Furthermore, the cylinder crank housing 3 is provided with a plurality of cooling ribs 21 in the area designated as 20 in the FIGURE.

Depending on the number of cylinders of the reciprocating internal combustion engine 1, one or more cylinder sleeves 4, made, for example, of cast iron, are inserted into the cylinder crank housing 3. An upper portion 22 of the cylinder sleeve 4 is clamped between the cylinder head 2 and the upper end 23 of the tubular piece 17 of receptacle 16 in the axial direction, whereas a lower portion 24 of the cylinder sleeve 4 is inserted into the receptacle 16 from above and extends therein.

To cool the cylinder sleeve 4, there is disposed in the cylinder crank housing 3 an annular space 25, which is provided with coolant (water) and is defined laterally in the upper portion 22 of the cylinder sleeve 4 by the outer side 26 of the cylinder sleeve 4 and the inner side 27 of the cylinder crank housing 3. Therefore, coolant flows directly around the upper portion 22 of the cylinder sleeve 4. Adjacent the portion 24 of the cylinder sleeve 4, the space 25 is defined by the outer side 28 of the tubular piece 17 of the receptacle 16 and the inner side 27 of the cylinder crank housing 3, i.e. the portion 24 is separated by the tubular piece 16 of the receptacle 16 from the coolant. Moreover, the space 25, filled with coolant, continues up into the cylinder head 2 so that the valve seats 10, 11 are also cooled.

Since the upper portion 22 of the cylinder sleeve 4 is subjected to particularly high thermal stress (in the vicinity of the combustion chamber 9), the space 25 in this region has a broad cross-section which is formed preferably by a reduced thickness in wall 29 of the outer periphery of the cylinder sleeve 4. The wall 29 extends between an upper shoulder 30 and a lower shoulder 31.

The upper shoulder 30 is used as a bearing surface for gasket 14, whereas the lower shoulder 31 rests on the upper end 23 of the tubular piece 17 of receptacle 16, with a second gasket 32 disposed therebetween.

Between the inner side 33 of the cylindrical receptacle 16 and the outer side 34 of portion 24 of the cylinder sleeve 4, there is provided a closed annular air space 35 which acts as an insulator. The air space 35 extends over a substantial partial region of the height of the receptacle 16. Between the air space 35 and the crank space 19, the cylinder sleeve 4 has an outwardly directed collar 36, which is arranged to provide a gas-tight seal with a bore 37 of the receptacle 16. The collar 36 is disposed adjacent the lower end 18 of the receptacle 16. An end region 38 of the cylinder sleeve 4 extending below collar 36 projects into the crank space 19 without being surrounded by the receptacle 16.

It will also be noted from the foregoing description that the cylinder sleeve 4 has alternating wall thicknesses over its length, such that it is adapted to mechanical and thermal stresses. For example, in the region of the constricted wall 29, the wall thickness of the cylinder sleeve 4 is greater than in the region between the lower shoulder 31 and the collar 36. The lower end region 38 of the cylinder sleeve 4 is again provided with a wall thickness which is less than the region between the lower shoulder 31 and the collar 36.

To achieve a low-vibration bearing of the cylinder sleeve 4, the latter has a relatively short clamped length. As can be seen from the drawing, the upper clamped portion 22 is approximately one third of the overall height of the cylinder sleeve 4.

While the present invention has been described by reference to a particular preferred embodiment, the invention is not to be limited thereby, but is to be limited solely by the claims which follow.

We claim:

1. An internal combustion engine comprising a cylinder crank housing, a cylinder head and a cylindrical receptacle disposed inside of said crank housing, a wet cylinder sleeve having an upper portion, said upper portion being clamped between said cylinder head and said receptacle, said cylinder sleeve also having a lower portion extending in said receptacle, a coolant space between the upper portion of said sleeve and said receptacle having a broad cross-sectional area and wherein said area is formed at least in part by a reduced wall thickness of said sleeve at a location in said upper portion, and a gas tight air space located between said lower portion of said sleeve and said cylindrical receptacle.

2. The invention set forth in claim 1 wherein the wall thickness of said sleeve is varied at a plurality of locations along its length.

3. The invention set forth in claim 1 wherein said reduced wall thickness portion of said sleeve is defined on either side by an upper and by a lower shoulder means.

4. The invention set forth in claim 3 wherein said lower shoulder means adjoins said receptacle and wherein a gasket is located therebetween.

5. The invention set forth in claim 4 wherein the lower portion of said sleeve includes a collar contacting said receptacle wherein said gas tight air space is formed intermediate said collar and said lower shoulder means.

6. The invention set forth in claim 1 wherein said air space extends along a substantial portion of the overall length of said receptacle.

7. The invention set forth in claim 5 wherein said sleeve includes a lowermost portion extending below said collar, the wall thickness of said lowermost portion being less than the wall thickness of said sleeve adjoining said air space.

8. The invention set forth in claim 5 wherein the wall thickness of said reduced wall thickness portion of said sleeve is greater than the wall thickness of said sleeve adjoining said air space.

9. The invention set forth in claim 1 wherein said clamped portion of said sleeve is about one-third the overall length of said sleeve.

* * * * *